US006478655B2

(12) United States Patent
Wu

(10) Patent No.: US 6,478,655 B2
(45) Date of Patent: Nov. 12, 2002

(54) REAR SUSPENSION MECHANISM FOR REMOTE CONTROL MODEL CAR

(76) Inventor: Chao-Chung Wu, 3F, No. 13, Alley 132, Lane 56, Sec. 3, Kangning Rd., Taipei (TW)

( * ) Notice: Subject to any disclaimer, the term of this patent is extended or adjusted under 35 U.S.C. 154(b) by 76 days.

(21) Appl. No.: 09/739,783

(22) Filed: Dec. 20, 2000

(65) Prior Publication Data

US 2002/0077025 A1 Jun. 20, 2002

(51) Int. Cl.[7] ..... A63H 17/26
(52) U.S. Cl. ..... 446/456; 446/469
(58) Field of Search ..... 446/454, 448, 446/456, 465, 466, 469, 470

(56) References Cited

U.S. PATENT DOCUMENTS 4,696,655 A * 9/1987 D'Andrade et al. ..... 446/466
5,762,533 A * 6/1998 Tilbor et al. ..... 280/43.23

* cited by examiner

*Primary Examiner*—Jacob K. Ackun
(74) *Attorney, Agent, or Firm*—Bacon & Thomas, PLLC

(57) ABSTRACT

A remote control model car includes a rear suspension mechanism mounted in either side of the chassis. The chassis has a suspension body. The rear suspension mechanism includes a pivotal adjustment rod coupled to the lug of the suspension body, a pivotal arm mechanism, a hub mechanism, and a shock absorber pivotably secured to the arm mechanism and the suspension body. This arrangement allows for a smooth, simple, and reliable wheel angle adjustment.

5 Claims, 5 Drawing Sheets

REAR SUSPENSION MECHANISM FOR REMOTE CONTROL MODEL CAR

FIELD OF THE INVENTION

The present invention relates to a rear suspension mechanism for a model jeep with improved characteristics.

BACKGROUND OF THE INVENTION

Conventionally, remote control model cars are classified as remote control model racing cars for planar ground or model jeeps for uneven terrain (as the subject matter of the invention). Hence, the construction of the latter is required to be more robust and capable of easily being adjusted. Typically, two rear wheels are driven by a drive source through a transmission mechanism. Further, a shock absorber is provided and associated with each rear wheel. Each of the front and the rear sides of wheel may be positioned at an angle with respect to the ground. An offset angle is defined as the angle of the rear transmission axle with respect to rear wheel in a horizontal plane. An inclined angle is defined as the angle of the surface of rear wheel with respect to a vertical plane. In general, the surface of rear wheel is inclined towards an inner side of a model jeep for increasing the centripetal force while manipulating the model jeep.

A schematic rear plan view in partial section of a conventional remote control model jeep is shown in FIG. 5. A transmission seat 17 is provided on chassis 1. A suspension body 11 is provided adjacent transmission seat 17. A bar on suspension body 11 is coupled to the top of hub mechanism 8. An arm mechanism 3 under the suspension body 11 is coupled to the bottom of the hub mechanism 8. A transmission rod 18 is passed through the universal joint 181 and the hub mechanism 8 to couple the transmission seat 17 and hub 19 of wheel together. Following is a description of the adjustment of the inclined angle and offset angle. As to the adjustment of the inclined angle, it is required that the bar is replaced, and hence it is inconvenient. As to the adjustment of the offset angle, a fastening block in the suspension body 11 is detached and replaced with a new fastening block. Fastening block is inserted through the shaft coupled to the suspension body 11. Thus the angle of the shaft may be adjusted. That is, the angle. of the shaft is determined by the positions of two end holes of fastening block. At this time, the angle of the shaft is identical to that of offset angle. In view of above, the adjustment of the offset angle is much more inconvenient. Further, the normal operation of the arm mechanism 3 may be adversely affected. As a result, most users only set up the model jeep in a less precise manner. Thus such model jeep does not perform well in a difficult terrain which in turn dissatisfies an enthusiastic user.

Thus, it is desirable to provide an improved rear suspension mechanism for remote control model jeep in order to overcome the above drawbacks of the prior art.

SUMMARY OF THE INVENTION

It is an object of the present invention to provide a rear suspension mechanism for a remote control model car for effecting a smooth, simple, and reliable wheel angle adjustment. Further, it is possible to adjust the distance between two rear wheels and the length of the model jeep.

To achieve the above and other objects, the present invention provides a remote control model car having a chassis with a rear suspension mechanism mounted in either side of the chassis, the chassis having a suspension body in the rear including a transmission seat, a coupling on either side of the transmission seat coupled to a universal joint at the internal end of a transmission rod, a lug on either side of the upper portion of the suspension body, a first ear on either side of the lower part of the suspension body, a fastening block at either front or rear side, a shaft secured bet a second ear on either side of the fastening block, and a shaft secured between the first and the second ears, the rear suspension mechanism comprising a pivotal adjustment rod coupled to the lug of the suspension body, the adjustment rod including a center enlargement, two threaded rods on either side of the center enlargement, and two end joints such that the length of the adjustment rod is adjustable by adjusting the securing of the threaded rods and the end joints; a pivotal arm mechanism including two sleeves put on the shaft between the first and the second ears, each sleeve being abutted on one of the first and the second ears; a hub mechanism having an upper part coupled to the adjustment rod and a lower part coupled to the arm mechanism respectively, one end of the transmission rod being passed through the universal joint to couple to a joint of a pin mechanism, the other end of the pin mechanism formed as a bar passed through the hub mechanism, a bearing put on the bar of the pin mechanism, the bearing placed within the hub mechanism the bar of the pin mechanism passed through the hub mechanism, a fastener sleeved on the bar and secured to a rear wheel, a pair of parallel adjustment members at the external ends of the arm mechanism being threadedly secured to a bolt having a ball-shaped head secured in one of two fork members of the hub mechanism; and a shock absorber having a bottom end pivotably secured to an engagement member of the arm mechanism and a top end secured to the suspension body.

The above and other objects, features and advantages of the present invention will become apparent from the following detailed description taken with the accompanying drawings.

DETAILED DESCRIPTION OF THE PREFERRED EMBODIMENTS

Figure 1:
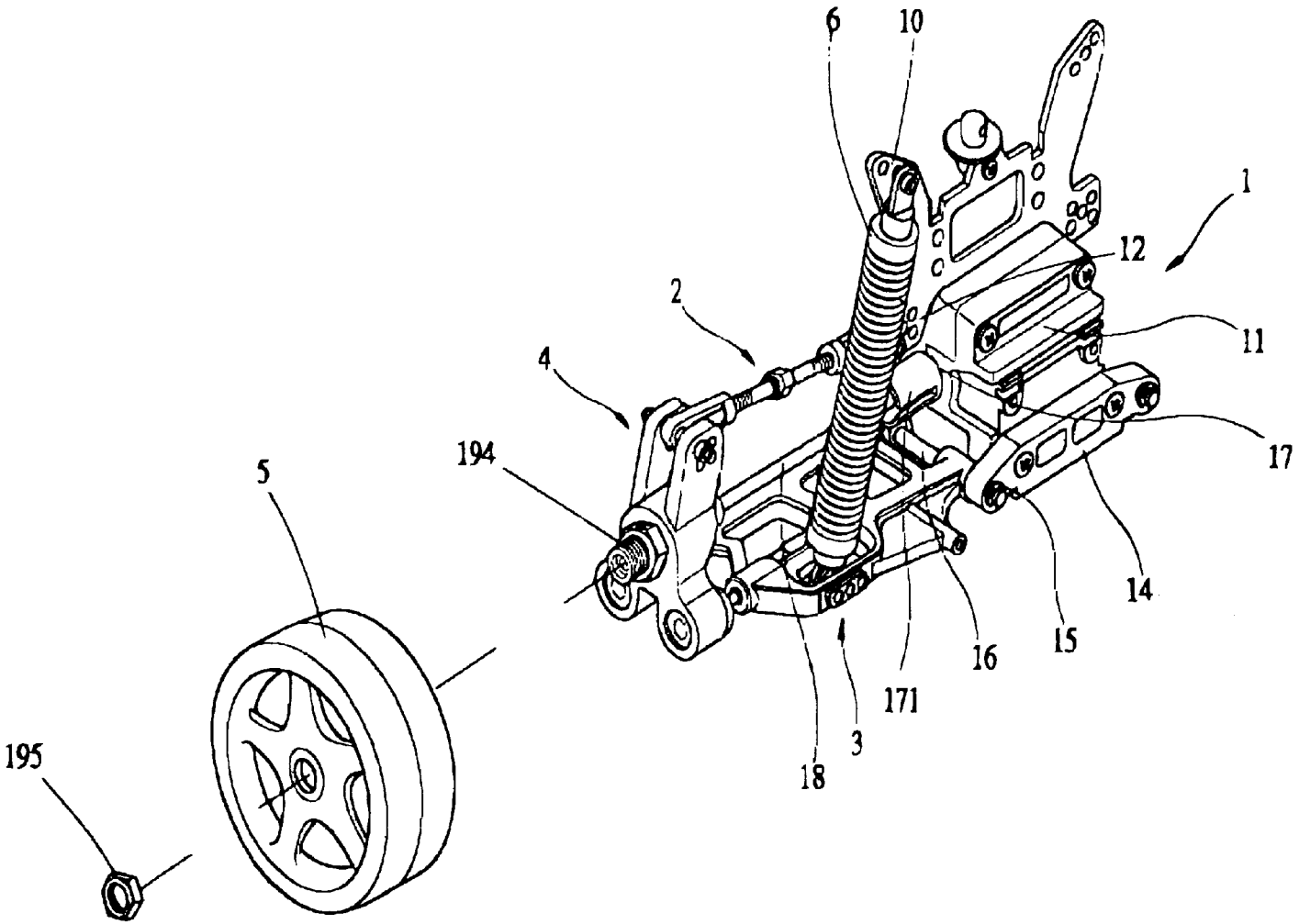
FIG. 1 is a perspective exploded view of a rear suspension mechanism for a remote control model jeep according to the invention.
Figure 2:
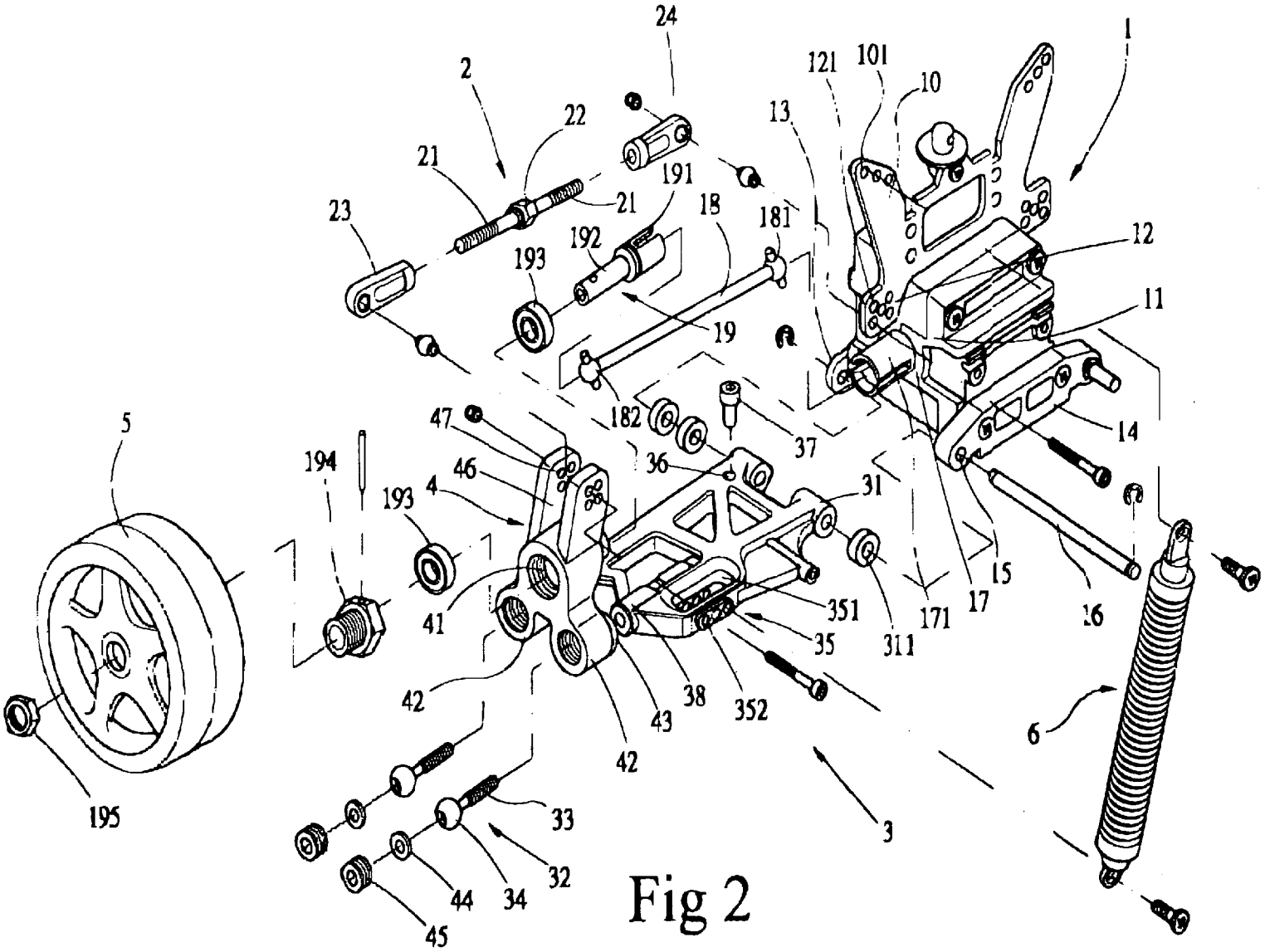
FIG. 2 is an exploded view of the FIG. 1.

Referring to FIGS. 1 through 4, there is shown a remote control model jeep incorporating a rear suspension mechanism in accordance with the invention. A suspension body 11 is provided in the rear of the chassis 1. A transmission seat 17 is provided in the suspension body 11. A coupling 171 on either side of the transmission seat 17 is coupled to a universal joint 181 at the internal end of the transmission rod 18. A lug 12 on either side of the upper part of suspension body 11 is coupled to the internal end of the adjustment rod 2. The lug 12 includes holes 121. Adjustment rod 2 has a center enlargement portion 22, two threaded rods 21 on either side of the center enlargement portion 22, and two joints 23 and 24 on both ends. The length of the adjustment rod 2 may be adjusted by adjusting the threading lengths of the joints 23 and 24 to the threaded rod 21. A first ear 13 is provided on either side of the lower part of the suspension body 11. A second ear 15 is provided on either side of the fastening block 14. A shaft 16 is secured between first and second ears 13 and 15. Both arm mechanism 3 and adjustment rod 2 may pivot. Two sleeves 31 of the arm mechanism 3 are put on the shaft 16 between the ears 13 and 15. Each sleeve 31 is abutted on either ear 13 or ear 15. The upper and lower parts of a hub mechanism 4 are coupled to the adjustment rod 2 and arm mechanism 3 respectively. One end of a transmission rod 18 is passed through the universal joint 182 to couple to a joint 191 of the pin mechanism 19. The other end of the pin mechanism 19 is formed as a bar 192 which is passed through the hole 41 of the hub mechanism 4. A bearing 193 is put on the bar 192 of the pin mechanism 19. Bearing 193 is placed within the hole 41 of the hub mechanism 4. Bar 192 of the pin mechanism 19 is passed through the hub mechanism 4. A fastener 194 is sleeved on the passed bar 192 and is positioned in the hub of the wheel 5. A nut 195 is secured to the external end of the fastener 194 such that the wheel 5 may rotate about the pin mechanism 19. A pair of parallel adjustment members 38 are provided at the external ends of the arm mechanism 3. A threaded hole is formed at one end of the parallel adjustment member 38 for threadedly securing to a threaded shank 33 of bolt 32. Ball-shaped head 34 of bolt 32 is placed in a threaded hole 43 of one of two fork members 42 at the lower portion of hub mechanism 4. Ball-shaped head 34 of bolt 32 is further secured by a washer 44 and nut 45. A shock absorber 6 has a bottom end pivotably secured to an engagement member 35 of the arm mechanism 3 and a top end secured to one of the holes 101 of the projecting member 10. Likewise, a plurality of holes 47 are formed at each of a pair of lugs 46 on the top of the hub mechanism 4. A threaded hole 36 is provided at the internal side of the arm mechanism 3. A screw 37 is secured in the threaded hole 36 wherein the bottom end of the screw 37 is projected from the underside of arm mechanism 3. Hence, the bottom end of the screw 37 is first in contact with the chassis 1 for being held thereto when the arm mechanism 3 is about to contact the top of the chassis 1. Then the wheel 5 is moved up together with the arm mechanism 3. In turn, the frame of the model jeep is lowered to prevent the arm mechanism 3 from contacting the ground. This is a safe mechanism. An opening 351 of the engagement member 35 is pivotably secured to the bottom end of the shock absorber 6 by inserting a pin through a plurality of holes 352. Hence, it is possible to adjust the tightness of the shock absorber 6 with respect 15 to the arm mechanism 3 by selecting one of the plurality of holes 352.

Figure 3:
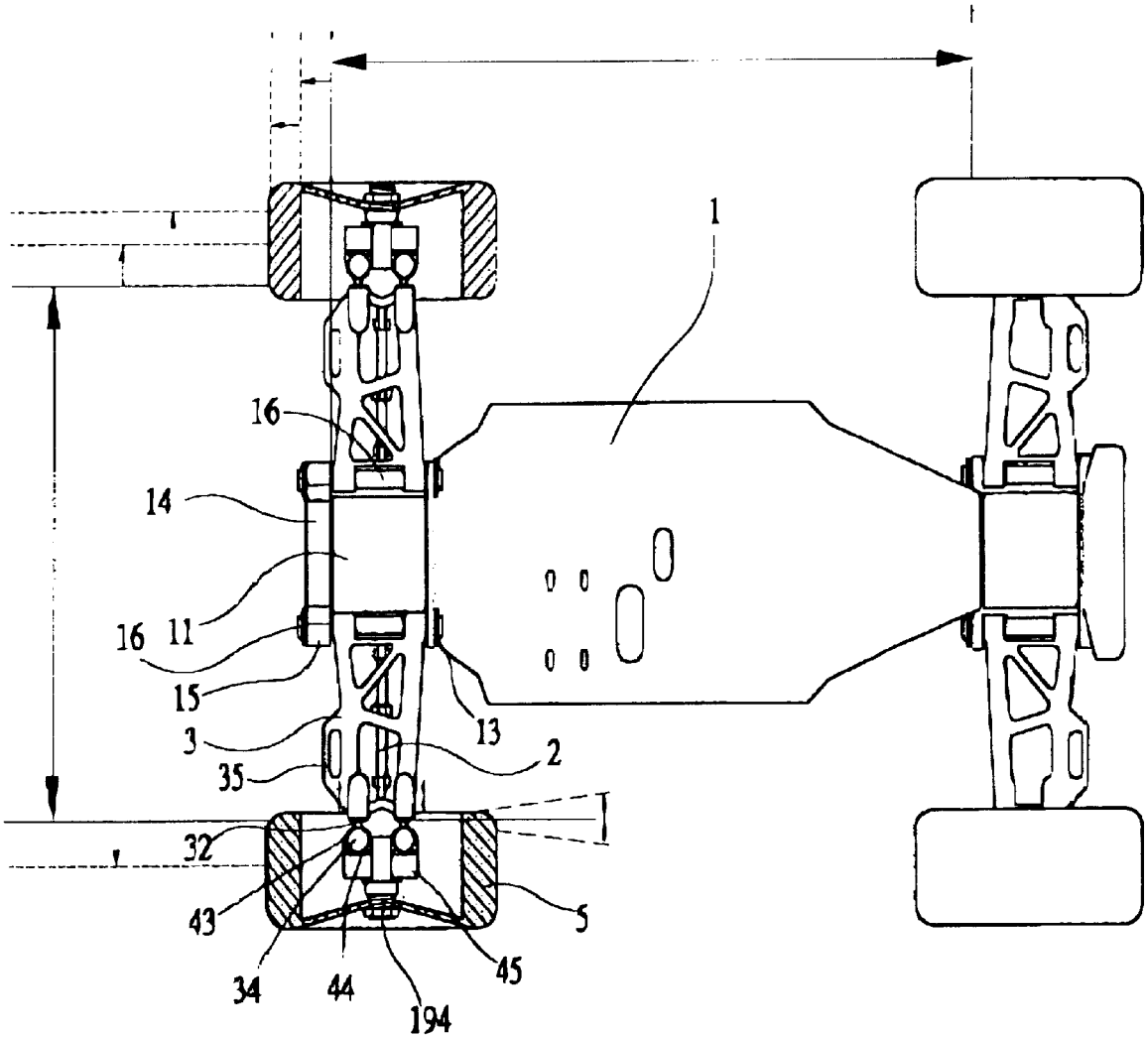
FIG. 3 is a schematic top plan view of the FIG. 1 model jeep illustrating the adjustment of offset angle.

Referring to FIG. 3 specifically, the angle adjustment of the offset angle may be effected by adjusting the positions of two bolts 32. In detail, nut 45 is loosened. Then, bolt 32 is adjusted to adjust the length of the arm mechanism 3. As a result, the angle adjustment of the offset angle may be carried out by simply using a box end wrench. Thus, it is very convenient.

Figure 4:
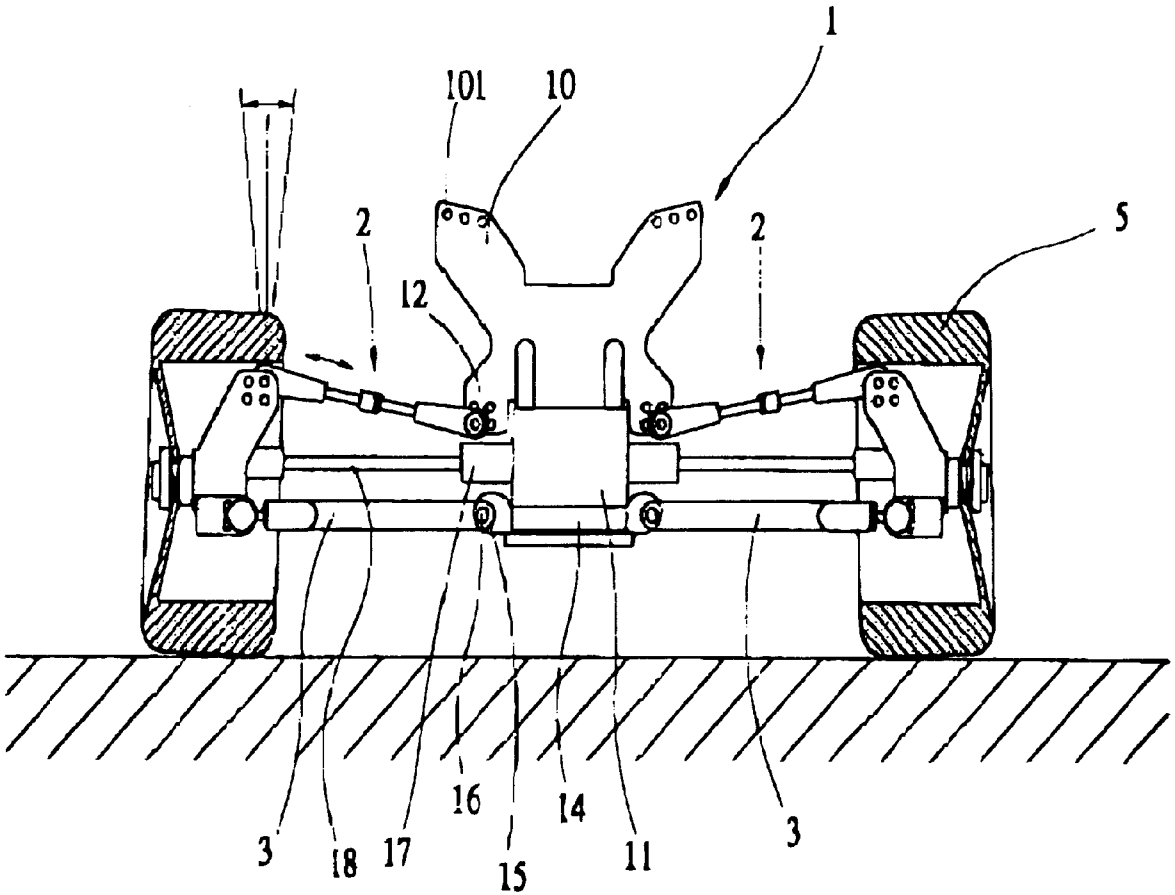
FIG. 4 is a schematic rear plan view in portion section of the FIG. 1 illustrating the adjustment of inclined angle.
Figure 5:
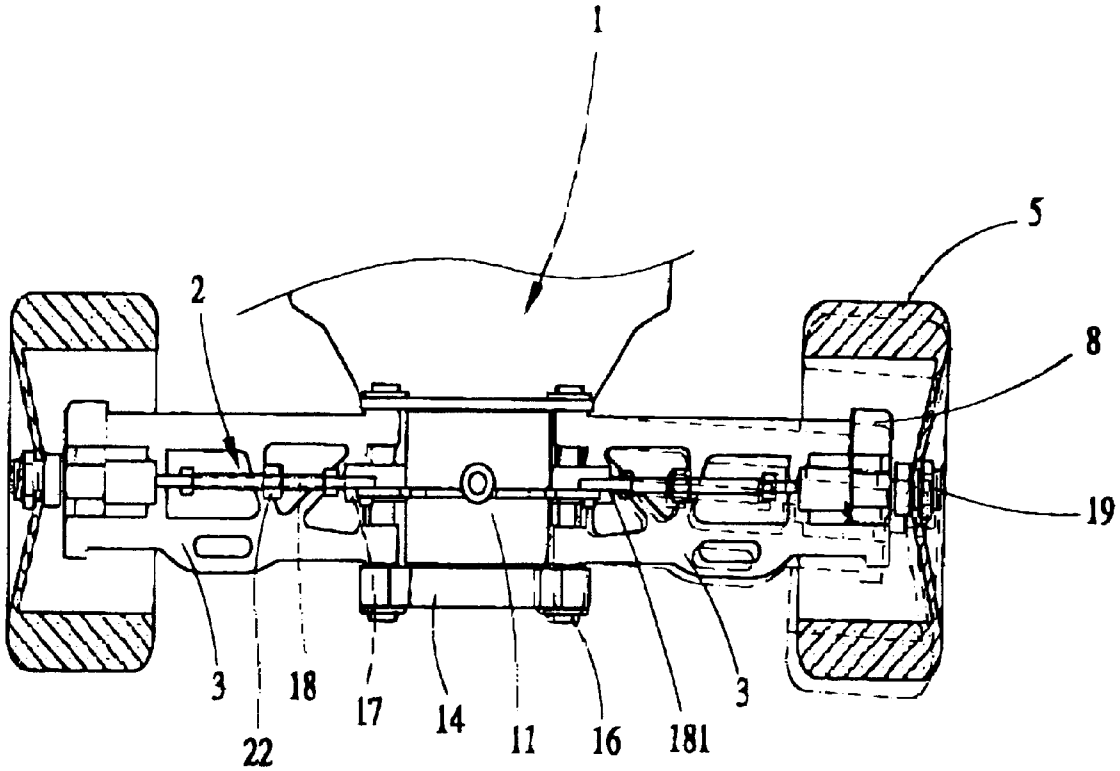
PRIOR ART Fig 5
FIG. 5 is a rear plan view with some parts shown in cross section of the rear suspension mechanism for a conventional remote control model jeep.

Referring to FIG. 4 specifically, the angle adjustment of the inclined angle may be effected by adjusting the adjustment rod 2. In detail, a user may turn the nut 45, or as stated above, select a suitable hole 352 to secure the shock absorber 6 to the arm mechanism 3. Thus a more flexible and effective adjustment of the inclined angle is carried out. Further, it is possible to adjust the distance between two rear wheels by turning the bolt 32 for adjusting the length of the arm mechanism 3. Furthermore, it is possible to adjust the length of the model jeep by adding or removing a plurality of washers 311 between the sleeves 31 and first ears 13 wherein washers 311 are put on the shaft 16.

While the invention has been described by means of specific embodiments, numerous modifications and variations could be made thereto by those skilled in the art without departing from the scope and spirit of the invention set forth in the claims.

What is claimed is:

1. A rear suspension mechanism mounted in either side of a chassis of a model car, said chassis having a suspension body in a rear thereof including a transmission seat, a coupling on either side of said transmission seat coupled to a universal joint at an internal end of a transmission rod, a lug on either side of an upper portion of said suspension body, a first ear on either side of a lower part of said suspension body, a fastening block at a front or rear side of said chassis, a shaft secured between a second ear on either side of said fastening block, and the shaft secured between said first and said second ears, said rear suspension mechanism comprising:

a pivotal adjustment rod coupled to said lug of said suspension body, said adjustment rod including a center enlargement portion, two threaded rods on either side of said center enlargement, and two end joints that are adjustable along the length of said adjustment rod;

a pivotal arm mechanism comprising two sleeves positioned on said shaft between said first and said second ears, each of said sleeves being abutted on one of said first and said second ears;

a hub mechanism having an upper part coupled to said adjustment rod and a lower part coupled to said arm mechanism respectively, one end of said transmission rod passed through said universal joint to couple to a joint of a pin mechanism, one end of said pin mechanism comprising a bar that is passed through said hub mechanism, a bearing positioned on said bar of said pin mechanism, said bearing placed within said hub mechanism, said bar of said pin mechanism passed through said hub mechanism, a fastener sleeved on said bar and securable to a rear wheel, a pair of parallel adjustment members positioned at external ends of said arm mechanism that are threadedly secured to a bolt having a ball-shaped head secured in one of two fork members of said hub mechanism; and a shock absorber having a bottom end pivotably secured to an engagement member of said arm mechanism and a top end secured to said suspension body.

2. The rear suspension mechanism as claimed in claim 1, wherein said suspension body further comprises a projecting member and a plurality of apertures on said projecting member.

3. The rear suspension mechanism as claimed in claim 1, wherein said hub mechanism further comprises a pair of lugs and a plurality of holes at each of the lugs.

4. The rear suspension mechanism as claimed in claim 1, wherein said arm mechanism further comprises a threaded hole at an internal side thereof and a screw secured in said threaded hole.

5. The rear suspension mechanism as claimed in claim 1, wherein said engagement member comprises an opening and a plurality of transverse holes adjacent said opening.

* * * * *